US012630343B2

(12) United States Patent
Pickett et al.

(10) Patent No.: US 12,630,343 B2
(45) Date of Patent: May 19, 2026

(54) DEVICE FOR VENTED FLOW FROM A BOTTLE

(71) Applicant: Cloud Candy LLC, Camarillo, CA (US)

(72) Inventors: Thomas G. Pickett, Camarillo, CA (US); Peter James Pickett, Camarillo, CA (US)

(73) Assignee: Cloud Candy LLC, Camarillo, CA (US)

( * ) Notice: Subject to any disclaimer, the term of this patent is extended or adjusted under 35 U.S.C. 154(b) by 15 days.

(21) Appl. No.: 18/947,483

(22) Filed: Nov. 14, 2024

(65) Prior Publication Data

US 2026/0054896 A1 Feb. 26, 2026

Related U.S. Application Data

(60) Provisional application No. 63/686,793, filed on Aug. 25, 2024.

(51) Int. Cl.
*B65D 51/16* (2006.01)

(52) U.S. Cl.
CPC ..... *B65D 51/16* (2013.01); *B65D 2205/02* (2013.01)

(58) Field of Classification Search
CPC .... B65D 51/16; B65D 2205/02; B65D 47/32; B65D 2205/00; B65D 25/48; A47G 19/2266; A47G 19/2272; A47G 21/186; A47G 21/18
USPC ..... 215/307, 228, 388; 220/709; 222/478, 222/527, 530
See application file for complete search history.

(56) References Cited

U.S. PATENT DOCUMENTS 877,396 A * 1/1908 Blair ..... B65D 33/06 222/530
2,481,719 A * 9/1949 Buck ..... B05B 9/0816 222/530
3,168,221 A * 2/1965 Parker ..... B65D 47/06 222/484
4,684,032 A * 8/1987 Tsay ..... A47J 41/0027 222/530
4,779,773 A * 10/1988 Bennett ..... B65D 47/2012 215/313
6,994,275 B2 * 2/2006 Hsiao ..... B65D 83/303 239/581.1
7,841,485 B1 * 11/2010 Rodriguez ..... B65D 17/4012 220/708

(Continued)

*Primary Examiner* — Laura E. Parker
(74) *Attorney, Agent, or Firm* — Ralph D Chabot

(57) ABSTRACT

The present invention discloses a device for facilitating vented flow during drinking from a bottle. The device comprises a housing and a removable base and a length of tubing spooled within. The base features an upward extending stem with an aperture through and extending perpendicularly to the longitudinal axis of the stem and a circular recess surrounding the stem. The housing includes a liquid outlet on the top surface, a circular sidewall sized to accommodate the neck of a bottle for temporary attachment, and a distal edge on the sidewall that fits within the circular recess to allow rotational movement of the base relative to the housing. Additionally, the housing has a recessed bottom surface with an air outlet for connection to the tubular length, an air inlet on the sidewall, and a tunnel connecting the air inlet to the air outlet.

11 Claims, 4 Drawing Sheets

(56) References Cited

U.S. PATENT DOCUMENTS

2013/0277329 A1* 10/2013 DeFelice ..... B65D 47/066
215/229

* cited by examiner

DEVICE FOR VENTED FLOW FROM A BOTTLE

FIELD OF THE INVENTION

The present invention relates to the field of liquid discharge from containers.

BACKGROUND

In the technical area of vented flow devices, a common issue is the bulkiness of existing designs. These devices, often used for facilitating the flow of liquids, tend to be large and cumbersome, making them difficult to transport and inconvenient for users who require portability. There is a need for addressing the bulkiness to improve convenience and ease of use in various settings, such as travel or outdoor activities. The bulkiness not only affects the practicality of carrying these devices but also limits their usability in situations where space is constrained.

Previous designs in this field have focused on performance, often resulting in large and cumbersome devices. This has led to products that, while effective in their primary function, are not user-friendly in terms of transport and storage. The limitations of these designs highlight the gap in the market for a solution that addresses both performance and portability without implying attempts to solve the problem.

Solving the issue of bulkiness in vented flow devices could bring several benefits. A compact and portable design would enhance user convenience, allowing individuals to easily carry the device in a pocket or small bag. This would be particularly advantageous for those who are frequently on the move or who have limited space.

SUMMARY

A device to provide vented flow when drinking from a bottle is disclosed. The device is compact, carry size for personal use and is reuseable.

The device comprises a housing having a cylindrical sidewall with an aperture, a base and incorporates a length of pliable tubing. The base comprises an upward extending centered stem having an aperture for insertion of one end of the tubing and a circular recess spaced equidistant from the stem. The distal end of the cylindrical sidewall of the housing is sized to be temporarily fitted about a bottle neck as well as to be received within the circular recess for rotational movement relative to the base. The sidewall aperature has a diameter slightly larger than the outside diameter of the tubing. One end of the tubing is inserted into the center aperture of the base and then the distal end of the sidewall is positioned within the recess of the base. The base can then be rotated relative to the housing to spool the tubing within the device in the space between the stem and interior surface of the sidewall.

The housing further comprises an air inlet, an air outlet, and a liquid outlet. The liquid outlet is located on the top surface of the housing. The air inlet inlet is located on the sidewall adjacent to the top surface. The air outlet is located on the bottom surface of the housing and is sized for temporary attachment with one end of the tubing.

The interior housing space is designed to accommodate a pre-determined length of tubing that is of sufficient length to reach the interior bottom of a bottle when the tubing is attached to the housing and the housing is about and contacting the outside surface of a bottle neck.

Because the device is designed to be compact, it is preferable the tubing be pliable so that the tubing wall can be flattened when wound about the stem. Most preferable, the tubing is constructed of a pliable, silicone-based composition.

Once the tubing occupies the annular space between the housing sidewall and the stem, the device can be carried by an individual, for example, in a pocket. When desired for use, the housing is separated from the base, causing the tubing to unwind. The tubing is disconnected from the center aperture and one end of the tubing is then connected to the air outlet located at the bottom surface of the housing with the distal end of the tubing inserted into a bottle. The housing is next positioned about the exterior surface of the bottle neck area to form a temporary seal preventing leakage of the liquid contents. As the bottle is raised by a person to drink from the bottle, the liquid contents of the bottle then flow out the liquid outlet at the top surface of the housing and into the mouth of the person. At the same time, air flows into the air inlet, out the air outlet, through the tubing, exiting out the distal end of the tubing at or near the interior base of the bottle.

In operation, as an individual drinks the liquid, an equivalent volume of air enters the distal end of the bottle thru air being supplied by the tubing.

In some aspects, the techniques described herein relate to a device for providing vented flow when drinking from a bottle including: a housing and a removable base; the base having an upward extending stem having an aperture through the stem extending perpendicularly to the longitudinal axis of the stem, and a circular recess positioned about the stem; the housing having a top surface with a liquid outlet, a circular sidewall sized for a neck of a bottle to be temporarily attached within, the circular sidewall further having a distal edge sized to be received within the circular recess for permitting rotation of the base relative to the housing, a recessed bottom surface having an air outlet configured for temporary attachment to a tubing length, an air inlet on the sidewall, a tunnel operatively connecting the air inlet to the air outlet; a space between the sidewall and stem for a tubing length to be spooled around the stem when the housing and base are attached and rotated relative to one another; and the tubing length removably connectable to the air outlet and to the aperture.

In some aspects, the techniques described herein relate to a device for providing vented flow when drinking from a bottle including: a housing and a removable base; the base having an upward extending stem and a circular recess positioned about the stem, an aperture through the stem extending perpendicularly to the longitudinal axis of the stem, and a first gripping area, the aperture sized to receive a portion of a tubing length; the housing having a top surface, a circular sidewall and edge, a second gripping area extending from the circular sidewall adjacent to the top surface, a bottom surface having a downward extending air outlet, the edge sized to be received within the circular recess of the base for permitting the base to rotate relative to the housing, a liquid outlet, an air inlet located through the second gripping area and an air outlet configured to be temporarily attached to a tubing length, where the liquid inlet is defined by the circular sidewall being of sufficient diameter to snuggly receive the neck of a bottle therein; a space between the sidewall and stem for a tubing length to be spooled around the stem when the housing and base are attached and rotated relative to one another; and a tubing length operatively connected to the air outlet and extending out of the liquid inlet for insertion into a bottle and where the liquid outlet is located on the end of the housing opposite of the liquid inlet.

In some aspects, the techniques described herein relate to a device for providing vented flow when drinking from a bottle including: a housing and a removable base; the base having an upward extending stem having an aperture through the stem extending perpendicularly to the longitudinal axis of the stem, and a circular recess positioned about the stem; the housing having a top surface with a liquid outlet, a circular sidewall sized for a neck of a bottle to be temporary attachment within, the circular sidewall further having a distal edge sized to be received within the circular recess for permitting rotation of the base relative to the housing, a recessed bottom surface having an air outlet configured for temporary attachment to a tubing length, an air inlet on the sidewall, a first tunnel portion extending into the housing from the air inlet, a second tunnel portion extending into the housing from the air outlet and operatively connected to the air inlet, the second tunnel portion further having a lip; a space between the sidewall and stem for a tubing length to be spooled around the stem when the housing and base are attached and rotated relative to one another; and the tubing length removably connectable to the air outlet and to the aperture.

DETAILED DESCRIPTION

Figure 1:
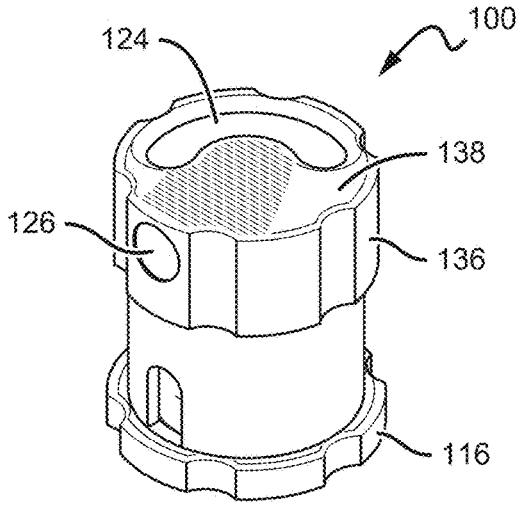
FIG. 1 is a perspective view of the device 100 when assembled.
Figure 2:
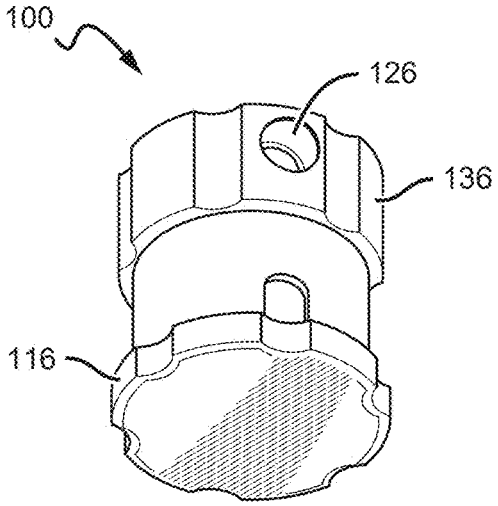
FIG. 2 is an alternative perspective view of the device 100 when assembled.
Figure 3:
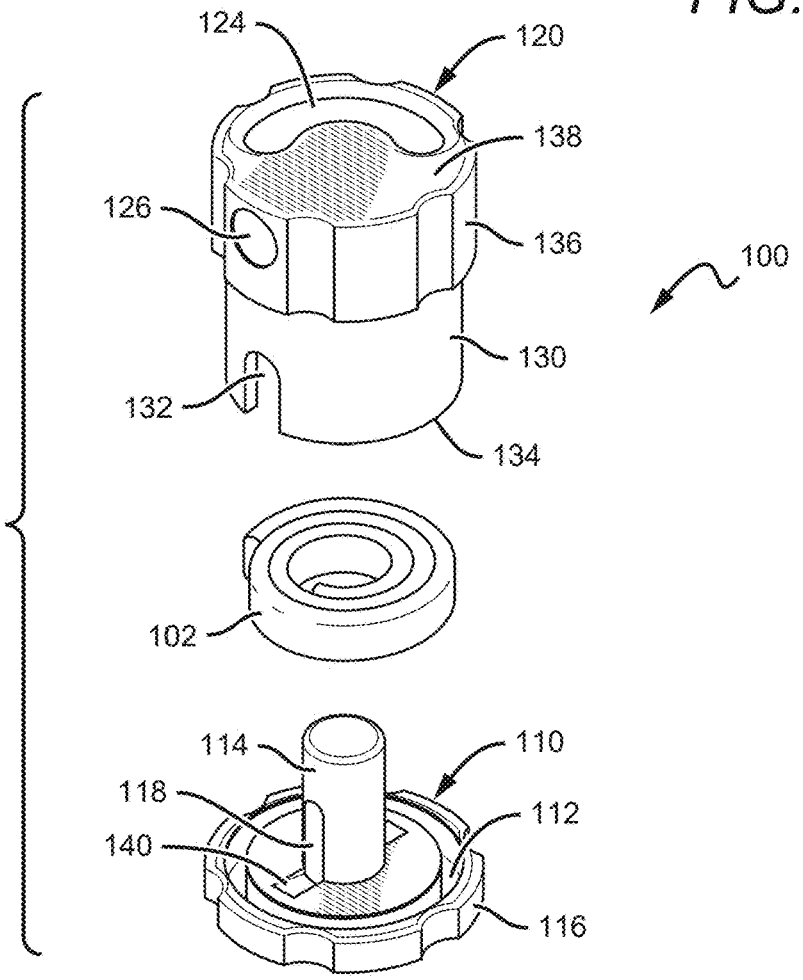
FIG. 3 is an exploded view of the device.
Figure 7:
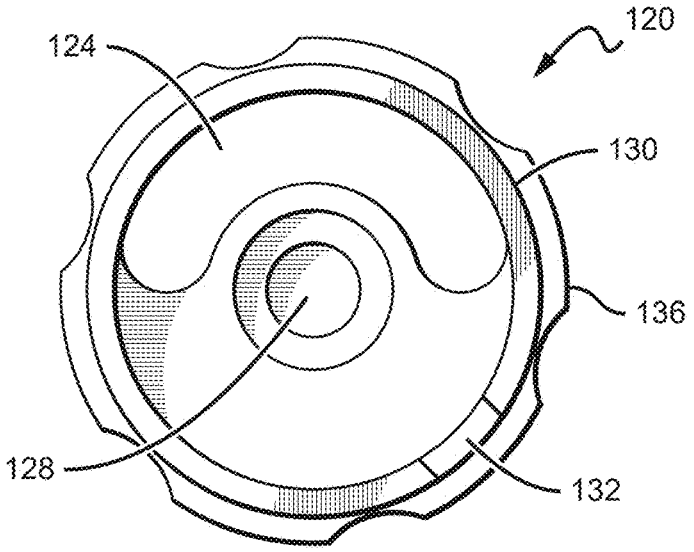
FIG. 7 shows the bottom recessed surface of the housing.
Figure 8:
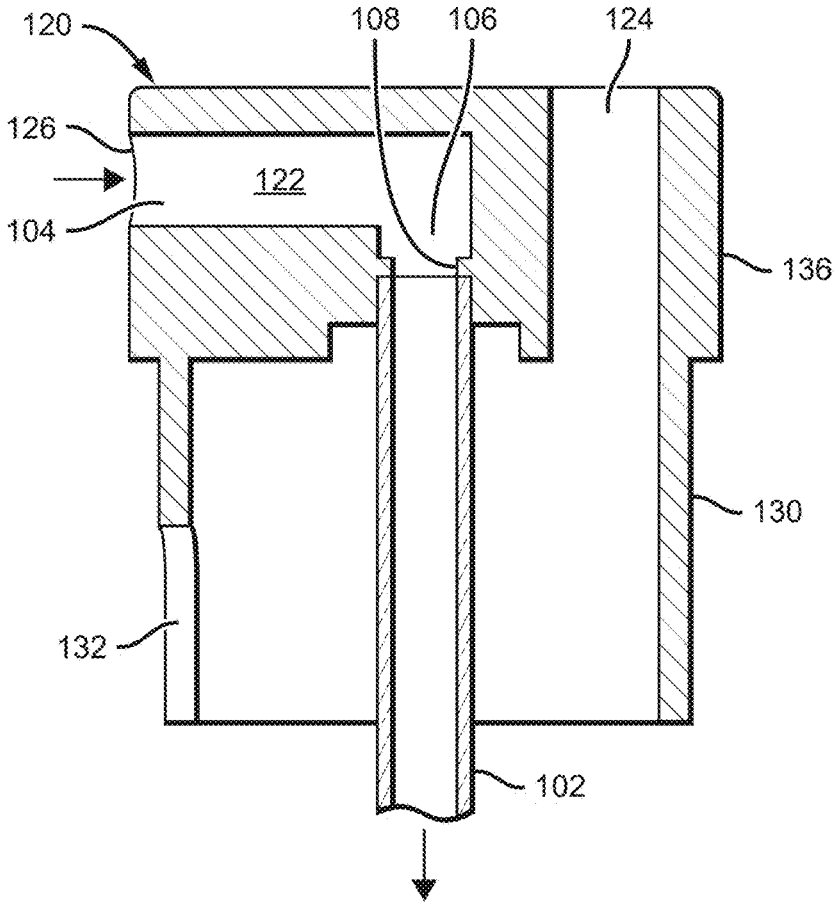
FIG. 8 is a side view showing temporary connection of tubing to the air outlet.

FIGS. 1 and 2 are perspective views of the device 100 assembled. FIG. 3 is an exploded view. Device 100 comprises base 110 and housing 120. Base 110 includes an upward extending stem 114 having an aperture 118 extending through stem 114 and extending perpendicularly to the longitudinal axis of the stem for insertion of a tubing end. Housing 120 includes a circular sidewall 130, top surface 138, and a bottom surface best illustrated in FIG. 7. Top surface 138 includes a liquid outlet 124. Sidewall 130 includes an air inlet 126 adjacent to the top surface. Bottom surface includes an air outlet 128 operatively connected to air inlet 126 via a tunnel 122. In the preferred embodiment, the tunnel comprises a first tunnel portion 104 horizontally extending inward from air inlet 126 and a second tunnel portion 106 extending inward from downward extending air outlet 128 which is sized to frictionally attach to one end of tubing 102. As best shown in FIG. 8, a lip 108 extends inward from the wall of second tunnel portion 106 to prevent tubing 102 from restricting air flowing from air inlet 126.

Base 110 and housing 120 contact each other as the edge 134 of sidewall 130 is accepted within recess 112 of the base. A U-shaped slot 132 is located on sidewall 130 for receiving tubing 102.

Figure 5:
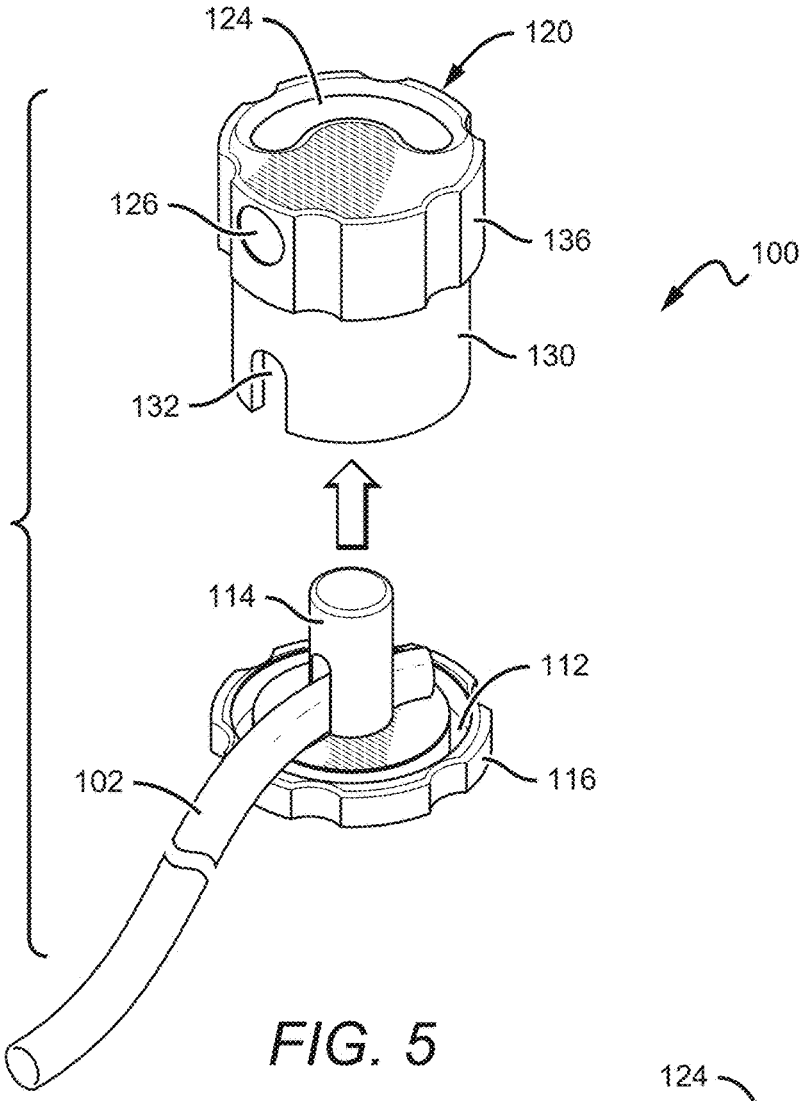
FIG. 5 illustrates the connection of the device.
Figure 6:
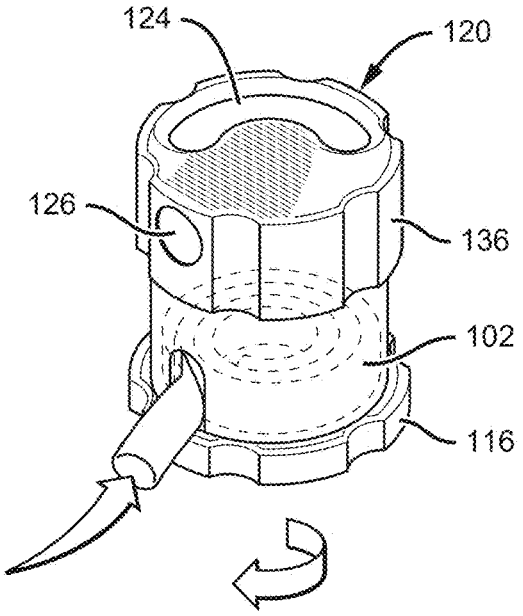
FIG. 6 illustrates rotation of the device to spool tubing.

As depicted in FIG. 5, one terminus of the tube is inserted into aperture 118, facilitating frictional engagement while housing 120 and base 110 remain disjoined. Following this insertion, the housing and base are coupled, with the distal edge of sidewall 130 positioned within the circular recess of base 110, permitting rotational movement of the base relative to the housing. First gripping area 116 and second gripping area 136 are provided to enable an individual to grasp each respective surface and rotate housing 120 in relation to base 110. This rotational movement causes tubing 102 to retract into the space defined between sidewall 130 and stem 114, as illustrated in FIG. 6.

During initial engagement, when sidewall 130 contacts recess 112, an individual stabilizes the base and housing using both hands. As tubing 102 is wound, the walls of the tubing are compressed due to the constrained space between the base and housing. This compression induces an outward force on sidewall 130, causing it to expand. The resultant expansion leads to the sidewall applying a frictional force against the outer surface of the recess, which is sufficient to secure the attachment between housing and base until a deliberate force is applied to separate them.

Housing 120 is preferably fabricated from thermoplastic polyurethane, with sidewall 130 featuring a wall thickness ranging from 0.055 to 0.070 inches. Base 110 is constructed from a rigid material, preferably nylon 66. Tubing 102 is preferably constructed of a silicone tubing and most preferably a silicone flexible tubing which returns to its original shape once a compressive force is released.

Figure 4:
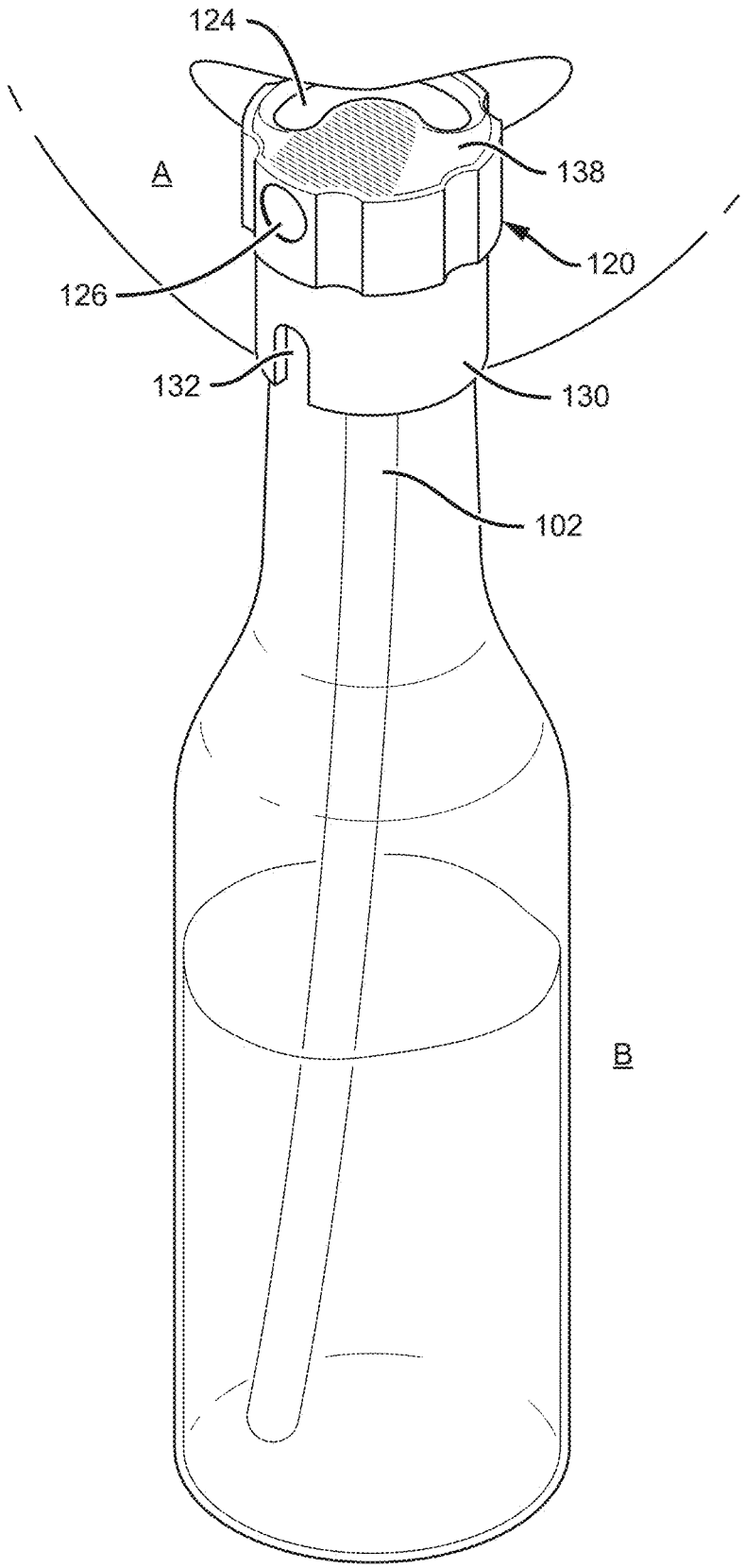
FIG. 4 is a view of the housing and tubing positioned for vented flow from a bottle.

The device, in its fully assembled condition is used for vented flow from a bottle as follows. Removable base 110 is separated from housing 120 and tubing 102 is separated from contact with aperture 118. Thereafter, one end of tubing 102 is temporarily attached to housing 120 at air outlet 128. Next, the unattached end of the tube is inserted into a bottle and housing sidewall 130 is thereafter positioned into temporary attachment with the outer surface of a neck of a bottle B. This contact will prevent liquid leakage as the bottle is tilted and the liquid inside consumed by an individual A as illustrated in FIG. 4.

Subsequent to drinking the liquid contents from a bottle, housing 120, base 110 and tubing 102 can be reassembled into device 100 using the sequence described earlier.

The invention claimed is:

1. A device for providing vented flow when drinking from a bottle comprising:

a housing and a removable base;

the base having an upward extending stem having an aperture through the stem extending perpendicularly to a longitudinal axis of the stem, and a circular recess positioned about the stem;

the housing having a top surface with a liquid outlet, a circular sidewall sized for a neck of a bottle to be temporarily attached within, the circular sidewall further having a distal edge sized to be received within the circular recess for permitting rotation of the base relative to the housing, a recessed bottom surface having an air outlet configured for temporary attachment to a tubing length, an air inlet, and a tunnel operatively connecting the air inlet to the air outlet;

a space between the sidewall and the stem for the tubing length to be spooled around the stem when the housing and base are attached and rotated relative to one another; and the tubing length removably connectable to the air outlet and to the aperture.

2. The device of claim 1 further comprising a U-shaped slot on the circular sidewall extending up the sidewall from the distal edge sized to permit the tubing length to pass through and be spooled about the stem.

3. The device of claim 2 in which the housing is constructed from thermoplastic polyurethane.

4. A device for providing vented flow when drinking from a bottle comprising:

a housing and a removable base;

the base having an upward extending stem and a circular recess positioned about the stem, an aperture through the stem extending perpendicularly to a longitudinal axis of the stem, and a first gripping area, the aperture sized to receive a portion of a tubing length;

the housing having a top surface, a circular sidewall and an edge, a second gripping area extending from the circular sidewall adjacent to the top surface, a bottom surface having a downward extending air outlet, the edge sized to be received within the circular recess of the base for permitting the base to rotate relative to the housing, a liquid outlet, an air inlet located through the second gripping area and an air outlet configured to be temporarily attached to a tubing length, where a liquid inlet is defined by the circular sidewall being of sufficient diameter to snuggly receive the neck of a bottle therein;

a space between the sidewall and the stem for the tubing length to be spooled around the stem when the housing and base are attached and rotated relative to one another; and the tubing length operatively connected to the air outlet and extending out of the liquid inlet for insertion into a bottle and where the liquid outlet is located on the end of the housing opposite of the liquid inlet.

5. The device of claim 4 further comprising a U-shaped slot on the circular sidewall extending up the sidewall from the distal edge sized to permit the tubing length to pass through and be spooled about the stem.

6. The device of claim 5 in which the housing is constructed from thermoplastic polyurethane.

7. A device for providing vented flow when drinking from a bottle comprising:

a housing and a removable base;

the base having an upward extending stem having an aperture through the stem extending perpendicularly to a longitudinal axis of the stem, and a circular recess positioned about the stem;

the housing having a top surface with a liquid outlet, a circular sidewall sized for a neck of a bottle to be temporarily attached within, the circular sidewall further having a distal edge sized to be received within the circular recess for permitting rotation of the base relative to the housing, a recessed bottom surface having an air outlet configured for temporary attachment to a tubing length, an air inlet on the sidewall, a first tunnel portion extending into the housing from the air inlet, a second tunnel portion extending into the housing from the air outlet and operatively connected to the air inlet, the second tunnel portion further having a lip;

a space between the sidewall and the stem for the tubing length to be spooled around the stem when the housing and base are attached and rotated relative to one another; and the tubing length removably connectable to the air outlet and to the aperture.

8. The device of claim 7 further comprising a U-shaped slot on the circular sidewall extending up the sidewall from the distal edge sized to permit the tubing length to pass through and be spooled about the stem.

9. The device of claim 8 in which the housing is constructed from thermoplastic polyurethane.

10. The device of claim 9 in which the sidewall has a thickness of between 0.055 to 0.070 inches.

11. The device of claim 7 in which the tubing length is constructed of silicone.

* * * * *